US005146907A

United States Patent [19]

Sawazaki et al.

[11] Patent Number: 5,146,907

[45] Date of Patent: Sep. 15, 1992

[54] IGNITION APPARATUS HAVING A CURRENT LIMITING FUNCTION FOR AN INTERNAL COMBUSTION ENGINE

[75] Inventors: Nobuyuki Sawazaki; Masaaki Taruya; Mitsuru Koiwa, all of Himeji, Japan

[73] Assignee: Mitsubishi Denki Kabushiki Kaisha, Tokyo, Japan

[21] Appl. No.: 774,234

[22] Filed: Oct. 10, 1991

[30] Foreign Application Priority Data

Oct. 12, 1990 [JP] Japan ..... 2-272105

[51] Int. Cl.[5] ..... F02P 9/00

[52] U.S. Cl. ..... 123/644

[58] Field of Search ..... 123/609, 610, 611, 644, 123/651

[56] References Cited

U.S. PATENT DOCUMENTS

| | | | |
|---|---|---|---|
| 4,403,591 | 9/1983 | Weber | 123/644 X |
| 4,403,592 | 9/1983 | Fritz | 123/644 X |
| 4,446,843 | 5/1984 | Rumbaugh et al. | 123/644 X |
| 4,469,082 | 9/1984 | Nishitoba et al. | 123/644 X |
| 4,899,715 | 2/1990 | Koiwa et al. | 123/644 |

FOREIGN PATENT DOCUMENTS

| | | | |
|---|---|---|---|
| 0324159 | 7/1989 | European Pat. Off. | 123/644 |
| 2064645 | 6/1981 | United Kingdom | 123/644 |

*Primary Examiner*—Willis R. Wolfe

*Attorney, Agent, or Firm*—Sughrue, Mion, Zinn, Macpeak and Seas

[57] ABSTRACT

An ignition apparatus for an internal combustion engine includes a current limiter for limiting a current supplied from a power source to an ignition coil to a predetermined maximum value irrespective of temperature variations. A current sensing resistor is connected between the power transistor and ground for sensing the magnitude of a primary winding current. A first constant current supply is connected at one end thereof to the base of the power transistor and at the other end to one end of the current sensing resistor through a first transistor. A second constant current supply is connected at one end thereof to the base of the power transistor and at the other end to the other end of the current sensing resistor through a second transistor. A differential amplifier has a first input terminal connected to a junction between the first constant current supply and the first transistor, a second input terminal connected to a junction between the second constant current supply and the second transistor, and an output terminal connected to the base of the power transistor. A temperature coefficient compensator is connected to one of the first and second input terminal of the differential amplifier for compensating for a change in the resistance of the current sensing resistor due to a variation in temperature so that a temperature dependent change in the reference voltage at the first input terminal of the differential amplifier matches a temperature dependent change in the voltage at the second input terminal thereof.

7 Claims, 2 Drawing Sheets

IGNITION APPARATUS HAVING A CURRENT LIMITING FUNCTION FOR AN INTERNAL COMBUSTION ENGINE

BACKGROUND OF THE INVENTION

The present invention relates to an ignition apparatus having a current limiting function for an internal combustion engine which serves to limit a primary current flowing in a primary winding of an ignition coil for limiting a secondary current flowing in a secondary winding thereof.

In general, internal combustion engines such as automotive gasoline engines have a plurality of cylinders for which the order of fuel injection, the order of ignition and the like are controlled in an optimal manner by mean of a computerized electronic control unit as called "ECU".

The ignition timing of the cylinders of such an engine is determined by cutting off the current supply to the primary winding of an ignition coil, and the secondary winding voltage developed across the secondary winding of the ignition coil upon cutting-off of the primary current supply requires to have high energy enough to generate a spark between the electrodes of a spark plug which is connected to the secondary winding of the ignition coil. In addition, it is necessary to limit the secondary winding voltage thus generated to a suitable energy level which does not cause dielectric breakdown of electronic or electric components of the ignition apparatus, the breakdown voltages for the components being determined in accordance with rated resistant voltages predetermined for the components. To this end, a maximum value of the primary winding current has to be limited to a prescribed value. However, the magnitude of voltage, which is supplied from a DC power supply such as a storage battery to the ignition coil for proper ignition, varies depending upon the operating condition of the engine, so it is general practice for the ignition apparatus to have a current limiting function for limiting the primary winding current to an appropriate level in accordance with the operating condition of the engine.

FIG. 3 illustrates the circuit arrangement of a typical example of such a type of ignition apparatus with a current limiting function for an internal combustion engine. In this figure, a DC power source 1 in the form of a storage battery, which generates a source voltage $V_B$, is connected to an ignition coil 2 which has a primary winding 2a and a secondary winding 2b of which the latter is connected to one of electrodes of a spark plug 3, whose the other electrode is connected to ground. A power transistor 4 comprising a pair of transistors coupled to form a Darlington circuit has a common collector connected to the primary winding 2a of the ignition coil 2, and a base connected through resistors 6, 7 to a node between a resistor 5, which is connected to a node between the storage battery 1 and the ignition coil 2, and a collector of a drive transistor 6 which has an emitter connected to ground. The drive transistor 6 is incorporated in an ECU (not shown).

A current limiter, generally designated by reference numeral 30, is connected between the base and emitter of the power transistor 4 and it is constructed as follows. A current sensing resistor 9 is connected between the emitter of the power transistor 4 and ground for sensing a primary voltage $V_D$ corresponding to a primary current $I_1$ which is generated by the primary winding 2a of the ignition coil 2 and flows through the power transistor 4. One end of the current sensing resistor 9 is connected through a resistor 10 to a negative or inverted input terminal of a differential amplifier 11. The other end of the current sensing resistor 9 is connected to ground, an emitter of a transistor 13, and the inverted input terminal of the differential amplifier 11 through a resistor 12. The differential amplifier 11 has an output terminal connected to a junction $P_1$ between the resistors 6, 7. The transistor 13 has a collector connected through a resistor 14 and a constant current supply 15 to the junction $P_1$ between the resistors 6, 7, and a base directly connected to the collector thereof to form a diode connection. The base of the transistor 13 is also coupled to a base of a transistor 16 which has a collector connected through a resistor 17 to the constant current supply 15, an emitter connected through a resistor 18 to ground, and a base connected through a resistor 19 to a positive or non-inverted input terminal of the differential amplifier 11. The collector of the transistor 16 is also coupled to a base of a transistor 21 which has a collector connected to the constant current supply 15 and an emitter connected to ground.

In operation, when the drive transistor 6 incorporated in the unillustrated ECU is turned off for starting the power supply to the ignition coil 2, the source voltage $V_B$ of the storage battery 1 is imposed on the base of the power transistor 4 through the resistor 5, thus turning the transistor 4 on. As a result, a primary current $I_1$ begins to flow from the storage batter 1 to ground by way of the primary winding 2a of the ignition coil 2, the collector-emitter of the power transistor 4 and the current sensing resistor 9. A voltage across the current sensing resistor 9 is applied to the inverted input terminal of the differential amplifier 11 through the resistors 10, 12.

At the same time, the current limiter 30 starts to control the base current $I_{B4}$ to the power transistor 4 so that the sensed voltage $V_D$ across the resistor 11 corresponding to the primary current $I_1$, which is applied to the inverted input terminal of the differential amplifier 11 through the resistors 10, 12, is made equal to a reference voltage $V_R$ which is generated across the base-emitter of the transistor 13 and imposed on the non-inverted input terminal of the differential amplifier 11 through the transistor 16 and the resistors 19, 20. That is, when the sensed voltage $V_D$ becomes equal to the reference voltage $V_R$, a part of base current $I_{B4}$, which is to be supplied to the base of the power transistor 4, is absorbed as a so-called sink current $I_S$ by the differential amplifier 11. As a result, the magnitude of the base current $I_{B4}$ supplied to the base of the power transistor 4 is accordingly reduced. In this manner, the primary current $I_1$ is controlled or limited to a level corresponding to the predetermined reference voltage $V_R$. In this connection, the sensed voltage across the current sensing resistor 9 input to the inverted input terminal of the comparator 11 varies with a change in the temperature of the resistor 9 because the resistance $r_9$ thereof has temperature dependency. Thus, the temperature-dependent change in the resistance $r_9$ of the current sensing resistor 9 is compensated for by changing the reference voltage $V_R$ so as to offset the change in the resistance $r_9$. That is, the reference voltage $V_R$ imposed on the non-inverted input terminal of the differential amplifier 11 is expressed by the following formula:

$$V_R = (kT/q)\log(Ie_{13}/Ie_{16}) + Vbe_{16} \times r_{20}/(r_{19} + r_{20}) \quad (1)$$
$$= (kT/q)\log(Ie_{13}/Ie_{16}) + (kT/q)\log(Ie_{16}/Is) \times r_{20}/(r_{19} + r_{20})$$
$$= (kT/q)\{\log(Ie_{13}/Ie_{16}) + \log(Ie_{16}/Is) \times r_{20}/(r_{19} + r_{20})\}$$

where k is Boltsmann's constant ($=1.38\times10^{-23}$ J/K); T is the absolute temperature of the transistors 13, 16; q is the charge of an electron ($=1.6\times10^{-19}$ coulomb); $Ie_{13}$ is the emitter current of the transistor 13; $Ie_{16}$ is the emitter current of the transistor 16; $Vbe_{16}$ is the base-emitter voltage of the transistor 16; Is the saturation current of the transistor 16 ($=5.38\times10^{-16}$ amperes at an absolute temperature of 300° K.); $r_{19}$ is the resistance of the resistor 19; and $r_{20}$ is the resistance of the resistor 20. As can be clearly seen from equation (1) above, the temperature-dependent change in the reference voltage $V_R$ can be compensated for by changing the ratio of the emitter current $Ie_{13}$ of the transistor 13 to that $Ie_{16}$ of the transistor 16 as well as a voltage dividing ratio determined by the resistances $r_{19}$, $r_{20}$ of the resistors 19, 20 (i.e., $r_{20}/(r_{19}+r_{20})$).

In this regard, however, the base-emitter voltage $Vbe_{16}$ of the transistor 16 has a negative characteristic with respect to the temperature change thereof, i.e., it decreases as the temperature thereof rises. Therefore, as clearly can be seen from equation (1) above, the temperature coefficient of the reference voltage $V_R$ can not be increased over a certain limit C1 which is expressed as follows:

$$C1=(k/q)\{\log(Ie_{13}/Ie_{16})$$

Thus, if the current limiter 30 comprises a hybrid IC with the current sensing resistor 9 being formed of a material such as aluminum, copper and the like having a relatively large temperature coefficient (i.e., greater than the above limit C1), it becomes difficult to make the temperature coefficient of the reference voltage $V_R$ match that of the current sensing resistor 9. In other words, in this case, there inevitably arises mismatching between the temperature coefficients of the voltages applied to the inverted and non-inverted input terminals of the differential amplifier 11, thus giving rise to temperature dependency of the limit value of a primary winding current as limited by the current limiter 30. That is, the current limiting value of the current limiter 30 drifts in accordance with variations in the temperature thereof, and hence it has a temperature depending characteristic which is undesirable. For this reason, it has hitherto been necessary to form the current sensing resistor 9 from materials having a low temperature coefficient such as a precious metal or alloy like a silver-palladium (Ag-Pd) alloy, silver, etc., which, however, are very expensive.

In addition, when considering stability and accuracy in operation of the current limiter 30 of FIG. 3, it is very important to stabilize the voltage applied to the junction $P_1$ by the storage battery 1. To this end, in order to compensate for or correct the temperature dependency of the base-emitter voltage $Vbe_4$ of the power transistor 4, it is necessary to substantially increase the resistance of the current sensing resistor 9 and/or employ the resistor 6 connected to the base of the power transistor 4.

SUMMARY OF THE INVENTION

In view of the above, the present invention is intended to overcome the above-described problems of the known ignition apparatus.

An object of the invention is to provide a novel and improved ignition apparatus with a current limiting function for an internal combustion engine which is able to compensate for the temperature dependency of a current sensing resistor with a simple and inexpensive construction so as to accurately limit the magnitude of a primary winding current for an ignition coil to a predetermined level irrespective of temperature variations without using an expensive current sensing resistor having a low temperature coefficient or without increasing the resistance of the current sensing resistor.

Another object of the invention is to provide a novel and improved ignition apparatus with a current limiting function for an internal combustion engine which is able to ensure stable and accurate operation of a current limiter at all times irrespective of variations in the output voltage of a power source without employing a stabilizing resistor as conventionally connected to the base of the power transistor.

In order to achieve the above objects, there is provided an ignition apparatus having a current limiting function for an internal combustion engine, which comprises: an ignition coil connected to a power source and having a primary winding and a secondary winding connected to a spark plug; a power transistor connected to the primary winding of the ignition coil for controlling the power supply from the power source to the ignition coil, the power transistor having a base connected to the power source through a switch; a current sensing resistor having a first end connected to the power transistor and a second end connecte to ground for sensing the magnitude of a primary winding current flowing through the primary winding of the ignition coil; a first constant current supply having one end thereof connected to the power source and the other end thereof connected to the first end of the current sensing resistor through a first transistor; a second constant current supply having one end thereof connected to the power source and the other end thereof connected to the second end of the current sensing resistor through a second transistor; a differential amplifier having a first input terminal connected to a junction between the first constant current supply and the first transistor, a second input terminal connected to a junction between the second constant current supply and the second transistor, and an output terminal connected to the base of the power transistor, the differential amplifier being operable to absorb a part of current supplied from the power source to the base of the power transistor in accordance with a difference between a reference voltage applied to the first input terminal of the differential amplifier and a voltage across the current sensing resistor as applied to the second input terminal of the differential amplifier to thereby limit the primary winding current to a predetermined value; and a temperature coefficient compensator connected to one of the first and second input terminals of the differential amplifier for compensating for a change in the resistance of the current sensing resistor due to a variation in temperature thereof so that a temperature dependent change in the reference voltage at the first input terminal of the differential amplifier matches a temperature dependent change in the voltage at the second input terminal of the differential amplifier.

In one form of the invention, the temperature coefficient compensator comprises: a third transistor having a base connected to the second input terminal of the differential amplifier; a first resistor connected between the base of the third transistor and the second input terminal of the differential amplifier; and a second resistor having one end thereof connected to a junction between the first resistor and the second input terminal of the differential amplifier and the other end thereof connected to a junction between the second and third transistors.

In another form of the invention, the temperature coefficient compensator comprises: a third transistor having a base connected to the first input terminal of the differential amplifier; a first resistor connected between the base of the third transistor and the first input terminal of the differential amplifier; and a second resistor having one end thereof connected to a junction between the first resistor and the first input terminal of the differential amplifier and the other end thereof connected to a junction between the first and third transistors.

Preferably, the current sensing resistor is made of aluminum or copper.

The above and other objects, features and advantages of the invention will be more readily apparent from the following detailed description of a presently preferred embodiment of the invention taken in conjunction with the accompanying drawings.

BRIEF DESCRIPTION OF THE DRAWING

In the drawing, the same or corresponding parts are identified by the same symbols through the embodiments.

DESCRIPTION OF THE PREFERRED EMBODIMENTS

A few preferred embodiments of the present invention will now be described in detail with reference to the accompanying drawing.

Figure 1:
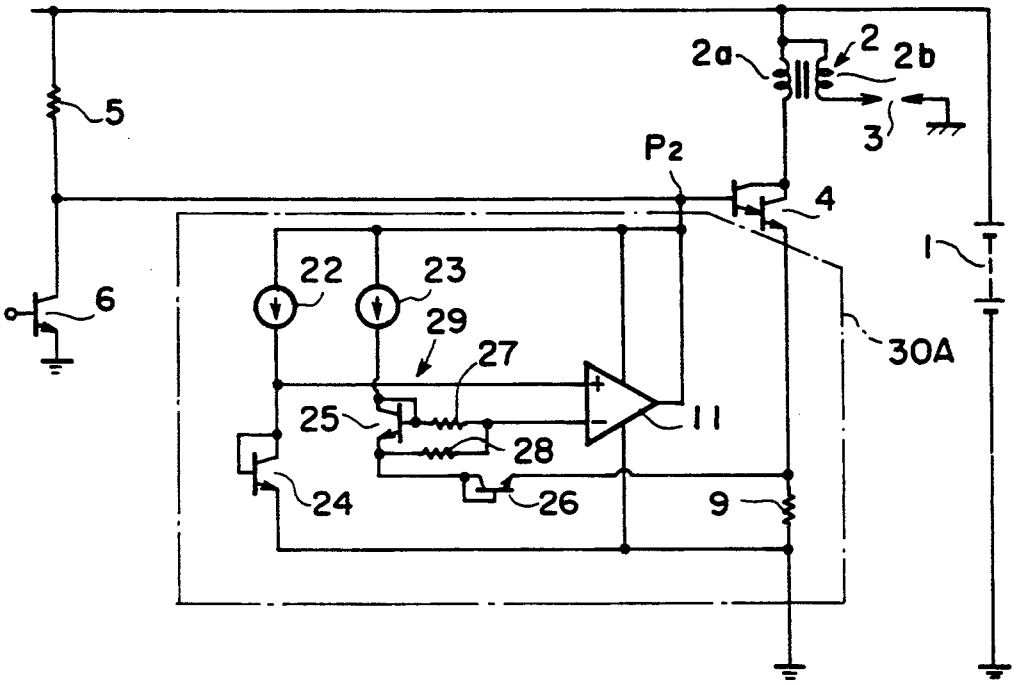
FIG. 1 is a schematic circuit diagram of an ignition apparatus having a current limiting function for an internal combustion engine in accordance with the present invention.

In FIG. 1, there is diagrammatically illustrated an ignition apparatus having a current limiting function for an internal combustion engine constructed in accordance with a first embodiment of the invention. The ignition apparatus illustrated includes a DC power source 1 in the form of a storage battery, an ignition coil 2 having a primary winding 2*a* and a secondary winding 2*b*, a spark plug 3, a power transistor 4, a resistor 5 and a switch 6 in the form of a drive transistor, a current sensing resistor 9, and a differential amplifier 11, all of which are the same as those employed in the known ignition apparatus of FIG. 2. In this embodiment, however, a current limiter, generally identified by 30A, is different from the one 30 of the known ignition apparatus of FIG. 1. Specifically, the current limiter 30A of this embodiment is constructed as follows. The power transistor 4 has a base directly connected to a junction between the resistor 5 and a collector of the drive transistor 6. A first constant current supply 22 and a second constant current supply 23 are provided which have their one end commonly connected to a junction $P_2$ between the base of the power transistor 4 and the junction of the resistor 5 and the collector of the drive transistor 6. The first constant current supply 22 has its other end connected to one end of the current sensing resistor 9 through a transistor 24 in the form of a diode connection in which has a collector coupled to the first constant current supply 22, a base directly coupled to the collector thereof, and an emitter connected to the one of the current sensing resistor 9. The second constant current supply 23 has its other end connected to the other end of the current sensing resistor 9 through a transistor 25 and a transistor 26 both in the form of diode connections. The transistor 25 has a collector coupled to the other end of the second constant current supply 23, a base directly coupled to the collector thereof and an emitter coupled to a collector of the transistor 26 which has a base directly coupled to the collector thereof and an emitter coupled to the other end of the current sensing resistor 9. The differential amplifier 11 has a reference or non-inverted input terminal connected to a junction between the first constant current supply 22 and the collector of the transistor 24, and a current-sensing or inverted input terminal connected to the base of the transistor 25 through a resistor 27 and to the emitter of the transistor 25 through a resistor 28.

In this connection, a reference voltage $V_R$, which is equal to the base-emitter voltage $Vbe_{24}$ of the transistor 24, is applied to the non-inverted input terminal of the differential amplifier 11 whereas the following voltage Vses is imposed on the inverted input terminal of the differential amplifier 11:

$$Vses = V_9 + Vbe_{26} + Vbe_{25} \times r_{28}/(r_{27} + r_{28}) \quad (2)$$

where $V_9$ is the voltage across the resistor 9; $Vbe_{26}$ is the base-emitter voltage of the transistor 26; $Vbe_{25}$ is the base-emitter voltage of the transistor 25; $r_{27}$ is the resistance of the resistor 27; and $r_{28}$ is the resistance of the transistor 28. In this regard, the base-emitter voltages of the transistors 25, 26 are expressed as follows:

$$Vbe_{25} = (kT/q)\log(Ie_{25}/Is) \quad (3)$$

$$Vbe_{26} = (kT/q)\log(Ie_{26}/Is) \quad (4)$$

where $Ie_{25}$ is the emitter current of the transistor 25; $Ie_{26}$ is the emitter current of the transistor 26; and Is the saturation current of the transistors 25, 26.

Using equation (4) above, equation (2) above is modified as follows:

$$\begin{aligned} Vses &= V_9 + (kT/q)\log(Ie_{26}/Is) + Vbe_{25} \times r_{28}/(r_{27} + r_{28}) \\ &= Ic \times r_9 + (kT/q)\log(Ie_{26}/Is) + Vbe_{25} \times r_{28}/(r_{27} + r_{28}) \end{aligned}$$

where Ic is the primary winding current flowing through the resistor 9.

The operation of this embodiment will now be described in detail. First, when the drive transistor 6 in the unillustrated current control unit such as an ECU is turned off, electric power is supplied from the storage battery 1 to the base of the power transistor 4 as well as to the current limiter 30A through the resistor 5. As a result, the power transistor 4 is turned on so that a current begins to flow from the storage battery 1 to ground through the primary winding 2a of the ignition coil 2, the now conductive power transistor 4 and the current sensing resistor 9. At the same time, the current limiter 30A starts its operation for limiting the magnitude of the primary winding current to a predetermined limit value $Ic_1$ on the basis of the following equation:

$$Ic_1=(1/r_9)\times[(kT/q)\log(Ie_{24}/Ie_{26})-Vbe_{25}\times\{r_{28}/(r_{27}+r_{28})\}] \quad (5)$$

where $r_9$ is the resistance of the resistor 9; $r_{27}$ is the resistance of the resistor 27; $r_{28}$ is the resistance of the resistor 28; $Ie_{24}$ is the emitter current of the transistor 24; $Ie_{26}$ is the emitter current of the transistor 26; and $Vbe_{25}$ is the base-emitter voltage of the transistor 25.

More specifically, there develops a difference between the base-emitter voltages of the transistors 24, 26 in accordance with the current ratio of the magnitude of current of the first constant current supply 22 to that of second constant current supply 23. For the sake of ease in understanding, this difference can be considered as a reference voltage $V_R$ applied to the reference or non-inverted input terminal of the differential amplifier 11. In addition, for the purpose of compensating for temperature dependency of the current limiting value of the current limiter 30A in cases where the current sensing resistor 9 is formed of a material such as aluminum, copper and the like having a large coefficient of temperature, a temperature coefficient compensator, generally identified by reference numeral 29, is connected to the current-sensing or inverted input terminal of the differential amplifier 11. The temperature coefficient compensator 29 comprises the transistor 25 and the resistors 27, 28 which are connected in the manner as described before. In this regard, the base-emitter voltage of the transistor 25 has negative temperature dependency in which it decreases in accordance with the increasing temperature of the transistor 25 in order to obtain the same magnitude of emitter current thereof. For example, as the temperature rises by 1 degree, the base-emitter voltage $Vbe_{25}$ should be changed by $-1.8$ mV to provide the same or constant emitter current. More specifically, a difference between a temperature dependent change in the base-emitter voltage of the transistor 24 as applied to the non-inverted input terminal of the differential amplifier 11 and the sum of a temperature dependent change in the voltage across the resistor 9 and temperature dependent changes in the base-emitter voltages of the resistors 25, 26 as applied to the inverted input terminal of the differential amplifier 11 is substantially offset or reduced to zero by properly selecting a voltage dividing ratio determined by the resistances $r_{27}$, $r_{28}$ of the resistors 27, 28 (i.e., $r_{28}/(r_{27}+r_{28})$).

For example, let us assume that the current limit Icl determined by the current limiter 30A and the resistance $r_9$ of the current sensing resistor 9 are set as follows:

$$Icl=6.5 \text{ amperes}$$

$$r_9=14\times10^{-3}\{1+4{,}300\times10^{-6}(T-300)\}\text{ohms}$$

where the resistance of the resistor 9 at an absolute temperature of 300° K. is 14 microohms; the temperature coefficient of the resistor 9 is 4,300 ppm; and T is the absolute temperature of the resistor 9. In this case, the emitter current $Ie_{24}$ of the transistor 24, the emitter current $Ie_{26}$ of the transistor 26, the resistance $r_{27}$ of the resistor 27 and the resistance $r_{28}$ of the resistor 28 are also assumed as follows:

$Ie_{24}=180$ microamperes at 25° C.

$Ie_{26}=60$ microamperes at 25° C.

$r_{27}=48$ kiloohms $r_{28}=1.2$ kiloohms

Calculating the reference voltage $V_R$ at the non-inverted input terminal and the sensed voltage Vses at the inverted input terminal of the differential amplifier 11 with the above values, the following results are obtained:

| Temperature (°C.) | −40 | 25 | 135 |
|---|---|---|---|
| $V_R$ (mV) | 796.4 | 689.9 | 501.7 |
| Vses (mV) | 797.6 | 690.9 | 502.1 |

Thus, the temperature coefficient for $V_R$ is $-2{,}115$ ppm over the temperature range of from $-40°$ C. to 135° C., and that for Vses over the same temperature range is $-2{,}117$ ppm.

Figure 2:
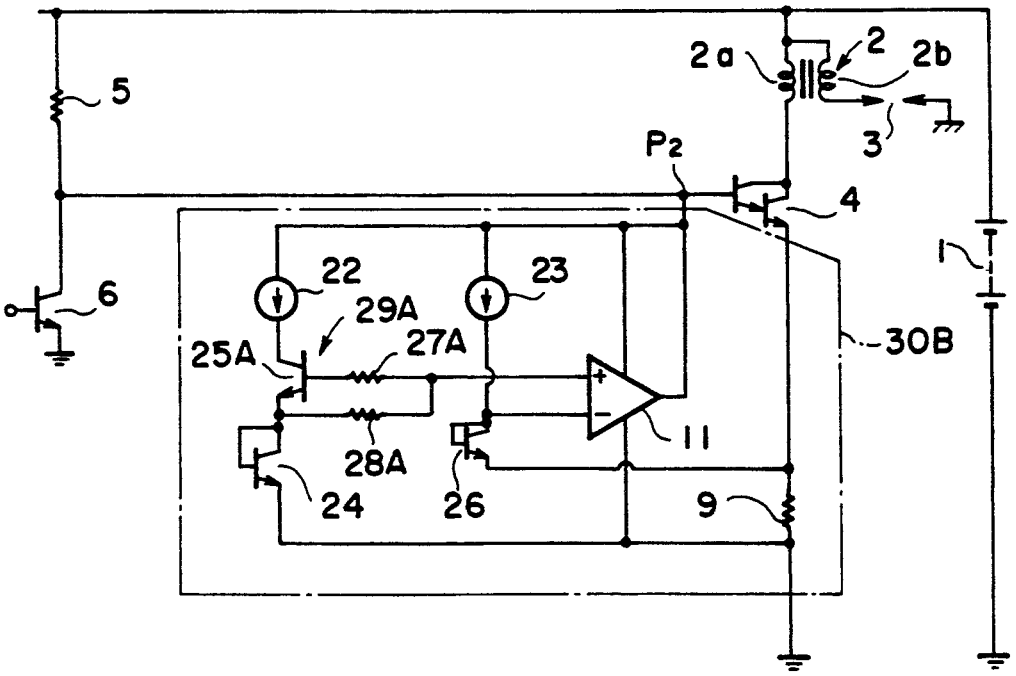
FIG. 2 is a view similar to FIG. 1, but showing another embodiment of the invention.

Although in the above embodiment, the temperature coefficient compensator 29 is connected to the inverted input terminal of the differential amplifier 11, it can instead be connected to the non-inverted input terminal of the differential amplifier 11 depending upon the magnitude of the temperature coefficient of the current sensing resistor 9, as shown in FIG. 2, while providing substantially the same effects as obtained by the embodiment of FIG. 1. Specifically, in this embodiment, a temperature coefficient compensator 29A comprises a transistor 25A having a collector connected to a first constant current supply 22, a base directly coupled to the collector thereof, and an emitter coupled to the collector of a transistor 24 whose emitter is connected to one end of a current sensing resistor 9; a resistor 27A connected between the base of the transistor 25A and the non-inverted input terminal of a differential amplifier 11, and a resistor 28A connected at one end thereof to a junction between the resistor 27A and the non-inverted input terminal of the differential amplifier 11 and at the other end thereof to the emitter of the transistor 25A. A transistor 26 has an emitter connected to the other end of the current sensing resistor 9, a collector connected to a second constant current supply 23, and a base directly coupled to the collector thereof. A junction between the second constant current supply 23 and the collector of the transistor 26 is connected to the inverted input terminal of the differential amplifier 11.

According to this embodiment, the temperature coefficient or change rate of the emitter-base voltage of the transistor 26 due to a temperature change is determined to be greater than that or change rate of the voltage across the resistor 9, and the sum of a temperature dependent change in the base-emitter voltage of the transistor 26 and a temperature dependent change in the voltage across the resistor 9 is substantially offset by the sum of a temperature dependent change in the base-emitter voltage of the transistor 24 and that of the transistor 25A by properly selecting a voltage dividing ratio determined by the resistors 27A, 28A (i.e., $r_{28A}/(r_{27A}+r_{28A})$).

For example, let us assume that the current limit Icl determined by the current limiter 30B of this embodiment and the resistance $r_9$ of the resistor 9 are set as follows:

$$Icl = 6.5 \text{ amperes}$$

$$r_9 = 25.6 \times 10^{-3}\{1 + 1{,}100 \times 10^{-6}(T - 300)\} \text{ ohms}$$

where the resistance of the resistor 9 at 300° K is 25.6 microohms; and the temperature coefficient of the resistor 9 is 1,100 ppm. Also, the emitter current $Ie_{24}$ of a resistor 24, the emitter current $Ie_{26}$ of the transistor 26, the resistances $r_{27A}$ and $r_{28A}$ of resistors 27A, 28A are assumed as follows:

$$Ie_{24A} = 120 \text{ microamperes}$$

$$Ie_{26A} = 40 \text{ microamperes}$$

$$r_{27A} = 48 \text{ kiloohms}$$

$$r_{28A} = 4.8 \text{ kiloohms}$$

Calculations of $V_R$ and Vses with the above values provide the following results:

| Temperature (°C.) | −40 | 25 | 135 |
|---|---|---|---|
| $V_R$ (mV) | 859.6 | 741.0 | 531.5 |
| Vses (mV) | 860.4 | 740.7 | 529.8 |

Accordingly, the temperature coefficient for $V_R$ is 2,181 ppm over a temperature range of from −40° C. to 135° C. and the temperature coefficient for Vses is 2,195 ppm over the same temperature range.

Thus, according to the present invention, due to the simplified circuit arrangement of the current limiter 30A or 30B, the reference voltage $V_R$ can be uniquely determined by the current ratio of the emitter current of the transistor 26 to that of the transistor 24 irrespective of variations in the output voltage of the power source 1. To this end, it is only necessary to make the ratio of the output current of the first constant current supply 22 to that of the second constant current supply 23 to a constant value at all times irrespective of variations in the voltage at the junction $P_2$ to which the output terminal of the differential amplifier 11 is connected, and there is no need to stabilize the output voltage of the power source 1 applied through the resistor 5 to the junction $P_2$. Accordingly, it is unnecessary to increase the resistance of the current sensing resistor 9 for reducing the influence of temperature on the resistance $r_9$ of the resistor 9 and/or to connect a voltage-stabilizing resistor to the base of the power transistor 4 for stabilizing the voltage at the junction $P_2$.

Figure 3:
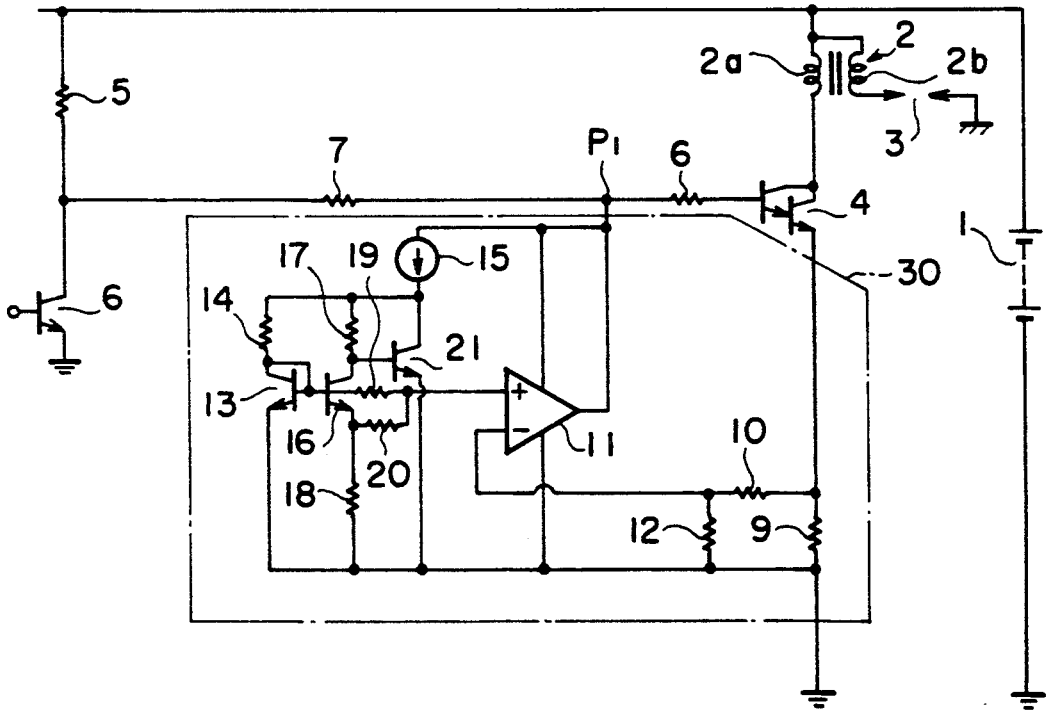
FIG. 3 is a view similar to FIG. 1, but showing a known ignition apparatus having a current limiting function.

In addition, since the temperature coefficient compensator 29A or 29B of the invention is effective to compensate for a greater change in the resistance of the current sensing resistor 9 due to a temperature variation thereof than with the known ignition apparatus of FIG. 3, the resistor 9 can be formed of materials having a relatively large temperature coefficient such as aluminum, copper and the like which are less expensive than precious materials having a low temperature coefficient such as an Ag-Pd alloy, silver and the like as conventionally employed. Accordingly, the current sensing resistor 9 can be formed of a wire of aluminum, copper and the like which can have a high resistance even with a limited cross section and a limited length, so that the dimensions or size of the resistor 9 can be reduced as compared with the case in which the resistor 9 is arranged in a planar film-like configuration on the surface of a ceramic substrate of a hybrid IC as in the conventional ignition apparatus of FIG. 3. This results in increased freedom for selection of a material for making the resistor 9, reduction in space requirement for installation of the resistor 9 as well as reduction in cost of the materials for the resistor 9.

What is claimed is:

1. An ignition apparatus having a current limiting function for an internal combustion engine, comprising:

an ignition coil connected to a power source and having a primary winding and a secondary winding connected to a spark plug;

a power transistor connected to the primary winding of said ignition coil for controlling the power supply from said power source to said ignition coil, said power transistor having a base connected to said power source through a switch;

a current sensing resistor having a first end connected to said power transistor and a second end connected to ground for sensing the magnitude of a primary winding current flowing through the primary winding of said ignition coil;

a first constant current supply having one end thereof connected to said power source and the other end thereof connected to the first end of said current sensing resistor through a first transistor;

a second constant current supply having one end thereof connected to said power source and the other end thereof connected to the second end of said current sensing resistor through a second transistor;

a differential amplifier having a first input terminal connected to a junction between said first constant current supply and said first transistor, a second input terminal connected to a junction between said second constant current supply and said second transistor, and an output terminal connected to the base of said power transistor, said differential amplifier being operable to absorb a part of current supplied from said power source to the base of said power transistor in accordance with a difference between a reference voltage applied to the first input terminal of said differential amplifier and a voltage across said current sensing resistor as applied to the second input terminal of said differential amplifier to thereby limit the primary winding current to a predetermined value; and a temperature coefficient compensator connected to one of the first and second input terminals of said differential amplifier for compensating for a change in the resistance of said current sensing resistor due to a variation in temperature thereof so that a temperature dependent change in the reference voltage at the first input terminal of said differential amplifier matches a temperature dependent change in the voltage at the second input terminal of said differential amplifier.

2. An ignition apparatus according to claim 1, wherein said temperature coefficient compensator comprises:

a third transistor having a base connected to the second input terminal of said differential amplifier;

a first resistor connected between the base of said third transistor and the second input terminal of said differential amplifier; and a second resistor having one end thereof connected to a junction between said first resistor and the second input terminal of said differential amplifier and the other end thereof connected to a junction between said second and third transistors.

3. An ignition apparatus according to claim 2, wherein the first input terminal of said differential amplifier is a non-inverted input terminal thereof, and the second input terminal of said differential amplifier is an inverted input terminal thereof.

4. An ignition apparatus according to claim 1, wherein said temperature coefficient compensator comprises:

a third transistor having a base connected to the first input terminal of said differential amplifier;

a first resistor connected between the base of said third transistor and the first input terminal of said differential amplifier; and a second resistor having one end thereof connected to a junction between said first resistor and the first input terminal of said differential amplifier and the other end thereof connected to a junction between said first and third transistors.

5. An ignition apparatus according to claim 4, wherein the first input terminal of said differential amplifier is a non-inverted input terminal thereof, and the second input terminal of said differential amplifier is an inverted input terminal thereof.

6. An ignition apparatus according to claim 1, wherein said current sensing resistor is made of aluminum.

7. An ignition apparatus according to claim 1, wherein said current sensing resistor is made of copper.

* * * * *